US009386820B2

(12) United States Patent
O'Reilly et al.

(10) Patent No.: US 9,386,820 B2
(45) Date of Patent: Jul. 12, 2016

(54) PRESSURE RELIEF SYSTEM FOR FOOTWEAR

(71) Applicant: Rikco International LLC, Vista, CA (US)

(72) Inventors: Brian O'Reilly, Mequon, WI (US); Roy Herman Lidtke, Elberon, IA (US)

(73) Assignee: RIKCO INTERNATIONAL LLC, Vista, CA (US)

( * ) Notice: Subject to any disclaimer, the term of this patent is extended or adjusted under 35 U.S.C. 154(b) by 627 days.

(21) Appl. No.: 13/835,830

(22) Filed: Mar. 15, 2013

(65) Prior Publication Data

US 2014/0259800 A1 Sep. 18, 2014

(51) Int. Cl.

| | |
|---|---|
| ***A43B 7/14*** | (2006.01) |
| ***A43B 13/12*** | (2006.01) |
| ***A43B 13/14*** | (2006.01) |

(52) U.S. Cl.

CPC ..... *A43B 7/1445* (2013.01); *A43B 7/149* (2013.01); *A43B 7/1485* (2013.01); *A43B 13/122* (2013.01); *A43B 13/145* (2013.01)

(58) Field of Classification Search

CPC ..... A43B 13/146; A43B 7/00; A43B 7/147; A43B 7/1455; A43B 7/148; A43B 7/1485; A43B 7/149; A43B 7/1445

USPC ..... 36/102, 140, 25 R, 103

See application file for complete search history.

(56) References Cited

U.S. PATENT DOCUMENTS

| | | | | | |
|---|---|---|---|---|---|
| 2,159,054 | A | * | 5/1939 | Silver | A43B 7/14 36/145 |
| 4,188,737 | A | * | 2/1980 | Haver | A43B 1/0036 36/131 |
| 4,538,480 | A | * | 9/1985 | Trindle | A43B 5/14 24/697.1 |
| 4,662,090 | A | * | 5/1987 | Solano | A43B 5/14 36/131 |

(Continued)

FOREIGN PATENT DOCUMENTS

| | | | |
|---|---|---|---|
| WO | WO 96/39061 | A | 12/1996 |
| WO | WO 99/53788 | A | 10/1999 |
| WO | WO 2013/022850 | A1 | 2/2013 |

OTHER PUBLICATIONS

International Search Report and Written Opinion (PCT/ISA/220) issued Sep. 10, 2014 in PCT/US14/21111, which corresponds to the present application.

*Primary Examiner* — Ted Kavanaugh

(74) *Attorney, Agent, or Firm* — Knobbe, Martens, Olson & Bear LLP

(57) ABSTRACT

Systems and methods are described for a shoe sole for relieving pressure from a wearer's metatarsal heads. In one aspect, a shoe sole comprises a shoe outer sole comprising a shaft region, a ball region, and a toe region. The shaft region underlies metatarsal shafts of the wearer and comprises a first lower surface, the ball region underlies metatarsal heads of the wearer and comprises a second lower surface, and the toe region underlies phalanges of the wearer and comprises a third lower surface. The second lower surface is raised relative to the first lower surface and the third lower surface.

17 Claims, 10 Drawing Sheets

(56) References Cited

U.S. PATENT DOCUMENTS

| | | | | | |
|---|---|---|---|---|---|
| 4,841,648 | A * | 6/1989 | Shaffer | A43B 7/1465 | 36/145 |
| 5,345,701 | A * | 9/1994 | Smith | A61F 5/14 | 36/127 |
| 5,438,768 | A * | 8/1995 | Bauerfeind | A43B 7/1425 | 36/165 |
| 5,974,699 | A * | 11/1999 | Park | A43B 13/148 | 36/103 |
| 7,104,158 | B2 * | 9/2006 | Harrington | A43B 5/14 | 74/594.4 |
| 2006/0064905 | A1 | 3/2006 | Hudson et al. | | |
| 2006/0123663 | A1 * | 6/2006 | Swensen | A43B 7/142 | 36/43 |
| 2010/0031530 | A1 | 2/2010 | Abshire | | |
| 2012/0060392 | A1 | 3/2012 | Pan | | |
| 2012/0096745 | A1 | 4/2012 | Donato | | |
| 2012/0159814 | A1 | 6/2012 | Smith et al. | | |
| 2012/0240430 | A1 * | 9/2012 | Shin | A43B 13/146 | 36/103 |

* cited by examiner

* Significantly Different from the Heel Height of 30 mm ($p<0.05$)

** Significantly Different from the Heel Height of 50 mm ($p<0.05$)

* Significantly Different from the Heel Height of 30 mm ($p<0.05$)

** Significantly Different from the Heel Height of 50 mm ($p<0.05$)

PRESSURE RELIEF SYSTEM FOR FOOTWEAR

BACKGROUND

Many individuals suffer from foot problems such as chronic foot pain, which adversely affects their daily lives by decreasing or impairing mobility. There are many different factors that may give rise to foot pain, such as disease, anatomical abnormalities, genetic disorders, and injuries. Aching or sensitive feet are common symptoms experienced by people suffering from one of these conditions, and an individual may feel discomfort while standing or walking. In an example, diabetes is a medical condition that causes a variety of foot problems. Many diabetics develop complications such as neuropathy, poor blood circulation, and ulcers. Ulcers are common on the ball of the foot due to the large amount of pressure that is exerted in this region on a daily basis. These complications are compounded in instances where the person wears high heel shoes. During the person's gait, the high heel elevates the person's heel, which consolidates the pressure of the gait on the metatarsal heads or ball of the foot, exacerbating the neurovascular and other complications. If the complications are not treated properly, they will often lead to permanent damage in the foot and may, in extreme cases, result in otherwise preventable amputations. Typically, to counteract those effects, people with diabetes wear specialized shoes or custom inserts such as orthotics to manage their symptoms and prevent further complications stemming from the disease.

Foot pain is often treated through special orthopedic shoes that have been modified to reduce the severity of the foot pain by evening out the pressure across the foot or removing pressure from specific parts of the foot. For example, orthopedic shoes generally include soft inserts that conform to the anatomical shape of the foot. Some insoles conform to the natural shape of a foot and also have a concave depression at the ball of the foot. While the design of soft inserts and insoles has steadily advanced in recent years, the design of shoe soles has not changed greatly. In particular, orthopedic shoes are bulky, heavy, and typically not considered to be as stylish as normal shoes, sometimes resulting in reluctance to wear the shoes.

SUMMARY

Disclosed herein are improvements in shoe sole designs that address problems with existing footwear and treatment options for addressing foot pain. Systems, devices, and methods provide for relieving pressure from a wearer's metatarsal heads during gait or standing. In one aspect, an improved shoe outer sole is provided for relieving pressure from the metatarsal heads. The shoe outer sole includes a shaft region, a ball region, and a toe region. The shaft region underlies the metatarsal shafts of the wearer and includes a first lower surface, the ball region underlies the metatarsal heads of the wearer and includes a second lower surface, and the toe region underlies the phalanges of the wearer and includes a third lower surface. The toe region is anterior to the ball region, which is anterior to the shaft region, and the second lower surface is raised relative to the first lower surface and the third lower surface. By raising the second lower surface relative to the first and third lower surfaces, the shoe outer sole causes the weight typically borne by the wearer's metatarsal heads to be shifted towards the wearer's metatarsal shafts and/or phalanges during gait or standing, thereby relieving pressure from the metatarsal heads.

In some implementations, the shoe outer sole includes a cavity positioned under the second lower surface and between the shaft region and toe region. The cavity may have a uniform height along a dimension of the shoe sole, where the dimension may be a width of the shoe sole and the cavity extends across substantially the entire width. The cavity relieves pressure from the metatarsal heads when the first lower surface is placed in contact with a ground surface and pressure is applied to the first lower surface. The relieved pressure is transferred from the ball region towards one or both of the shaft region and the toe region.

In some implementations, the second lower surface is raised relative to the first lower surface by a first height J, and the second lower surface is raised relative to the third lower surface by a second height K different from J. J may be greater than K, which would modify a gait cycle applied by the wearer while wearing a shoe having the shoe sole. In particular, the modification increases the length of time that the first lower surface contacts a ground surface during the gait cycle. By increasing the length of time, the modification relieves pressure from the metatarsal heads by transferring the relieved pressure from the ball region towards the shaft region. A relationship between J and K may be defined by $J=X\times K$, where X is between 1 and 2, and J and K may be each between about 1 and 3 mm.

In some implementations, the shoe sole has an upper surface including a first portion disposed above the shaft region, a second portion disposed above the ball region, and a third portion disposed above the toe region. The first portion is raised relative to the second portion and the third portion. The first portion has a transversely varying height that varies between medial and lateral points, and the second portion may include a depression. The first, second, and third portions may be included in a midsole or an insole of the shoe sole.

In some implementations, the shoe sole includes a heel region disposed in the outer sole so as to underlie the wearer's heel. The heel region is posterior to the shaft region and comprises an upper surface that is elevated relative to the shaft region, ball region, and toe region.

Another aspect relates to a shoe sole for relieving pressure from a wearer's metatarsal heads, comprising a shaft region and a ball region. The shaft region supports metatarsal shafts of the wearer and comprises a first upper surface having a transversely varying height. Anterior to the shaft region is the ball region, which supports metatarsal heads of the wearer and includes a depression on a second upper surface.

In some implementations, the transversely varying height varies between medial and lateral points. Portions of the first upper surface support a first subset of the metatarsal shafts are raised relative to a second subset of the metatarsal shafts. The first subset may include second, third, and fourth metatarsal shafts and the second subset includes first and fifth metatarsal shafts.

In some implementations, the transversely varying height of the first upper surface and the depression cause pressure to be relieved from a subset of the metatarsal heads. The pressure on the metatarsal heads is relieved by transferring pressure from the ball region towards the shaft region and/or towards the toe region. In some implementations, the depression has a transversely uniform depth.

In some implementations, the shoe sole includes a toe region anterior to the ball region for supporting the phalanges of the wearer. The toe region includes a third upper surface that is raised relative to the depression on the second upper surface. In this case, the shaft region includes a first lower surface, the ball region includes a second lower surface, and the toe region includes a third lower surface, where the second lower surface is raised relative to the first lower surface and the third lower surface. The second lower surface may be raised relative to the first lower surface by a first height J, and the second lower surface is raised relative to the third lower surface by a second height K different from J. The first, second, and third lower surfaces may be included in an outsole of the shoe sole.

In some implementations, the first and second upper surfaces are included in a midsole or an insole of the shoe sole. The insole may be removable from the shoe sole and/or customized for the wearer.

In some implementations, the first upper surface is associated with a first stiffness amount, and the second upper surface is associated with a second stiffness amount less than the first stiffness amount. In some implementations, the shoe sole includes a heel region posterior to the shaft region for supporting the wearer's heel, and includes an upper surface that is elevated relative to the first and second upper surfaces.

Another aspect relates to a method for relieving pressure from a person's metatarsal heads. The method includes placing vertical pressure on a ball region of the shoe that underlies a person's metatarsal heads (e.g., while the person is taking a step in a shoe, or standing while wearing the shoe), and transferring at least a portion of the vertical pressure in a direction generally anterior or posterior from the ball region.

In some implementations, the transferred portion of the pressure reaches a shaft region located posterior to the ball region. In various implementations, a dress shoe is provided with one or more shoe structures and methods provided herein. In certain applications, the methods, and shoe structure devices are configured within a "high heel" shoe, such as a women's dress shoe. Such shoes have heels that are higher than about 1 inch, or even higher than about 2 inches, or 3 or 4 inches.

Variations and modifications of these embodiments will occur to those of skill in the art after reviewing this disclosure. The foregoing features and aspects may be implemented, in any combination and subcombinations (including multiple dependent combinations and subcombinations), with one or more other features described herein. The various features described or illustrated above, including any components thereof, may be combined or integrated in other systems. Moreover, certain features may be omitted or not implemented.

BRIEF DESCRIPTION OF THE DRAWINGS

The foregoing and other objects and advantages will be apparent upon consideration of the following detailed description, taken in conjunction with the accompanying drawings, in which like reference characters refer to like parts throughout, and in which.

DETAILED DESCRIPTION

To provide an overall understanding of the systems, devices, and methods described herein, certain illustrative embodiments will now be described. For the purpose of clarity and illustration, these systems and methods will be described with respect to pressure relieving shoe soles. It will be understood by one of ordinary skill in the art that the systems, devices and methods described herein may be adapted and modified as is appropriate, and that these systems, devices and methods may be employed in other suitable applications, such as for other types of shoes and shoe soles, and that other such additions and modifications will not depart from the scope hereof.

Figure 1A:
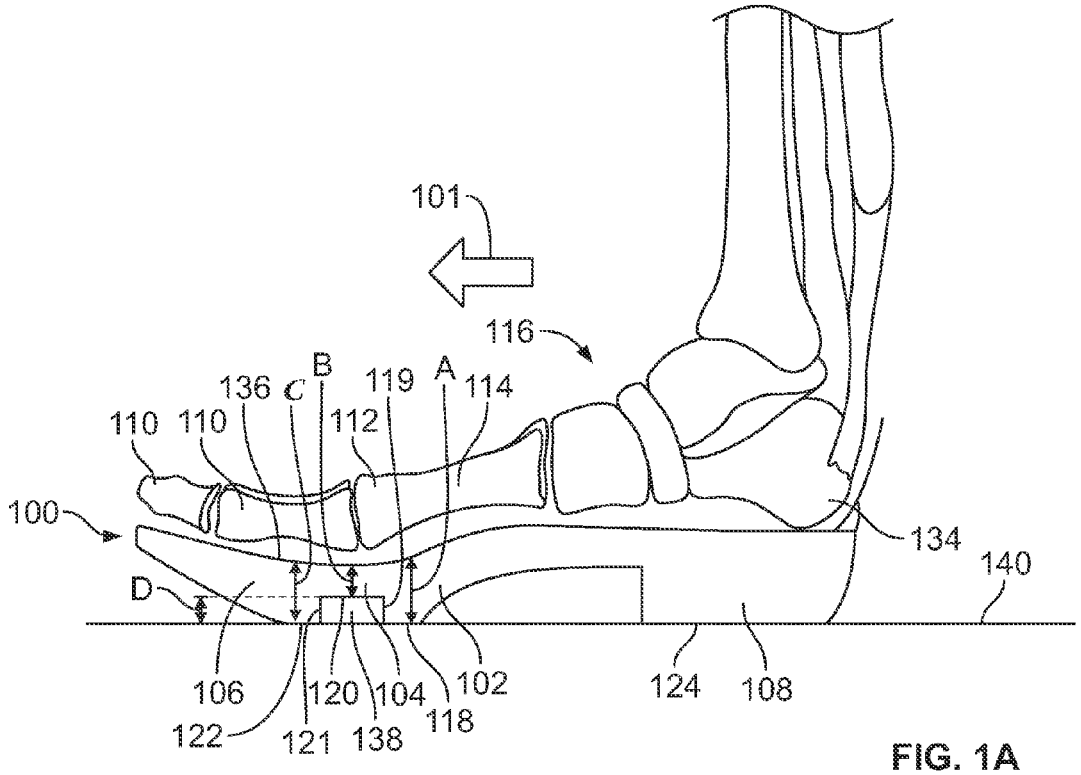
FIG. 1A shows a side view of a shoe sole for relieving pressure from a wearer's metatarsal heads.
Figure 1B:
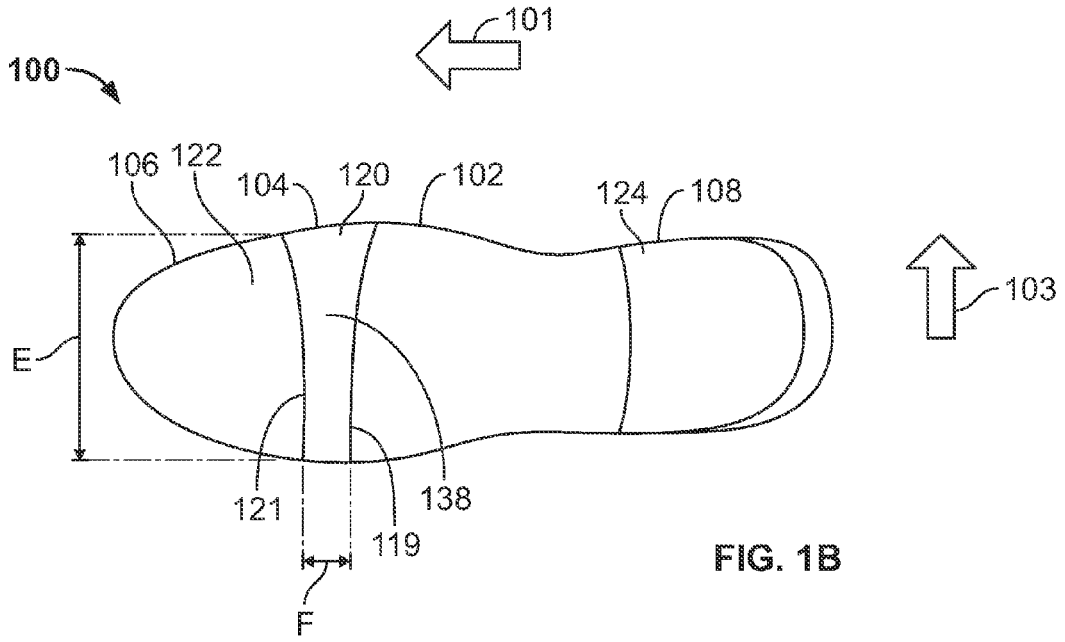
FIG. 1B shows a bottom view of the shoe sole of FIG. 1A.

FIGS. 1A and 1B show a side view and bottom view, respectively, of a shoe sole 100 for relieving pressure from a wearer's metatarsal heads 112, according to an illustrative implementation. The shoe sole 100 is an outsole including multiple connected regions underlying parts of a wearer's foot. In particular, the shoe sole 100 includes a shaft region 102 underlying the wearer's metatarsal shafts 114, a ball region 104 underlying the wearer's metatarsal heads 112, a toe region 106 underlying the wearer's phalanges 110, and a heel region 108 underlying the wearer's heel 134. The regions 102, 104, 106, and 108 are connected such that the toe region 106 extends anteriorly, in the direction 101, from the ball region 104, which extends anteriorly from the shaft region 102, which extends anteriorly from the heel region 108. As shown in FIG. 1A, an upper surface 136 of the regions 102, 104, 106, and 108 varies smoothly and is shaped to support different regions of the wearer's foot 116. In contrast, a lower surface of the shoe sole 100 includes multiple discrete portions, including a cavity 138 positioned below the ball region 104 underlying the wearer's metatarsal heads 112. In particular, the shaft region 102, the ball region 104, and the toe region 106 have different thicknesses A, B, and C, respectively, where the thickness B is less than both thicknesses A and C. A lower surface 120 of the ball region 104 is raised relative to a lower surface 118 of the toe region 102 and to a lower surface 122 of the shaft region 106. The relative raising of the lower surface 120 compared to the lower surfaces 122 and 118 forms the cavity 138 underlying the ball region 104.

One function of the cavity 138 is to relieve pressure from the metatarsal heads 112, compared to a shoe sole without such a cavity. Because the cavity 138 is positioned below the metatarsal heads 112, the lower surfaces 118 and 122 may contact the ground 140 and the lower surface 120 may not contact the ground 140 while the wearer is standing. This means that when the wearer wears a shoe including the shoe sole 100, the shaft region 102 and the toe region 106 may each exert an upward force resisting the weight of the wearer that is greater than an amount of upward force exerted by the ball region 104. Thus, pressure is transferred away from the wearer's metatarsal heads 112 and towards the wearer's metatarsal shafts 114 and/or the wearer's phalanges 110. The transfer of pressure may have the same effect while the wearer is standing, walking, jogging, or running while wearing the shoe. In particular, while the wearer is walking, jogging, or running while wearing the shoe, as the foot 116 rolls forward, the lower surface 118 and 122 will make contact with the ground 140 while the surface 120 does not contact the ground 140. This means that the ground reaction force vector (i.e., the force that is equal in magnitude and opposite in direction to the force that the wearer's body exerts on the supporting surface through the foot 116) of the shoe sole 100 will have a direct transfer of load onto the metatarsal shafts 114 and the phalanges 110 while producing only an indirect load on the metatarsal heads 112.

As shown in FIGS. 1A and 1B, the cavity 138 has a substantially rectangular cuboid shape, with height D, width E, and length F. The side view shown in FIG. 1 may be an exaggerated view of the shoe sole 100 to show the cavity 138. As shown in FIG. 1A, the height D of the cavity 138 is similar to the thickness B of the ball region 104. In general, the height D may be the same or different from the thickness B. In some implementations, it is desirable to provide pressure relief to the wearer's metatarsal heads 112 while maintaining an inconspicuous design. In this case, it may be desirable to use a low height D of the cavity 138 (such as on the order of 1 to 3 mm, for example) such that the presence of the cavity 138 still provides comfort to the wearer but is not obvious to an observer. In general, any suitable value for the height D may be used. The height D of the cavity 138 may be experimentally varied to determine an appropriate value or range of values that provide relief to the metatarsal heads 112. Depending on one or more desirable characteristics of the shoe (maximal comfort, inconspicuous design, for example) one or more suitable values for the height D may be determined. Furthermore, the value for the height D may be determined based on the value for one or more of the thicknesses A, B, or C. In particular, suitable values or ranges may be determined for the differences, ratios, or deviations between the values to determine appropriate parameters for the various dimensions of the shoe sole 100. As shown in FIG. 1A, the height D is the same across a length of the cavity 138. In particular, the height D of a posterior side surface 119 (between the cavity 138 and the shaft region 102, just posterior of the wearer's metatarsal heads 112) is the same as the height D of an anterior side surface 121 (between the cavity 138 and the toe region 106, just anterior of the wearer's metatarsal heads 112). However, in general, the height D may vary along the length of the cavity 138 between the side surfaces 119 and 121. An example implementation of a shoe sole with a cavity with varying height is described in detail in relation to FIG. 2.

The length F defines a length of the ball region 104 as well as a length of the cavity 138 and extends from the posterior side surface 119 to the anterior side surface 121. As shown in FIG. 1B, the length F of the cavity 138 varies in a transverse direction 103 (i.e., lateral-to-medial) such that the length F is larger on a medial side of the shoe sole 100 and smaller on a lateral side of the shoe sole 100. The length F of the cavity 138 may vary in this way such that the cavity 138 substantially underlies the metatarsal heads 112. In an example, the length F may be on the order of 2-5 cm on the medial side and 1.5-4.5 cm on the lateral side, though in general, any suitable range of values for F may be used. Furthermore, the length F may depend on a size of the shoe. In some implementations, rather than varying across a width of the shoe sole 100, the length F of the cavity 138 is substantially uniform across the width. In either case, as described above, the length F may be determined such that the cavity 138 is positioned to substantially underlie the wearer's metatarsal heads 112, therefore providing pressure relief to the metatarsal heads 112 by exerting less force resisting the weight of the wearer's foot 116 at the metatarsal heads 112.

As shown in FIG. 1B, the width E extends transversely across an entire width of the shoe sole 100, such that the cavity 138 is surrounded on three sides by the lower surface 120 and the side surfaces 119 and 121. It may be desirable for the cavity 138 to extend across the width of the shoe sole 100 to allow for less resistive force on either lateral or medial side of the metatarsal heads 112. Furthermore, extending the cavity 138 across the width of the shoe sole 100 may cause the shoe sole 100 to be more flexible and less resistant to changes in the foot's shape as the wearer wears the shoe. In some implementations, it may be desirable to limit the width E of the cavity 138 such that the cavity 138 extends across a portion of the width of the shoe sole 100. In this case, material may cover one or both sides (i.e., the medial and/or lateral sides) of the cavity 138 such that the cavity 138 is surrounded with four or five surfaces instead of three surfaces.

The cavity 138 is shown for illustrative purposes only, and is just one implementation of the systems and methods described herein. In general, the cavity may have any shape, such as a semi-elliptical shape or any other suitable shape. Furthermore, the cavity 138 may be uniform in one or more dimensions of the shoe sole 100, or the cavity may vary along one or more dimensions of the shoe sole 100. In some implementations, the cavity 138 is filled with air, such that the cavity 138 is only defined by the three surfaces 119, 120, and 121. Having an empty cavity may be desirable for facilitating the transfer of pressure away from the wearer's metatarsal heads 112 and towards the wearer's metatarsal shafts 114 and/or phalanges 110. In other implementations, the cavity 138 or a portion thereof is filled with a fluid material or a solid material. In particular, the material in the cavity may be made of a different material from a remainder of the shoe sole. In an example, the cavity 138 is filled or partially filled with a gel or a foam substance. In this case, however, when the wearer wears a shoe including a filled cavity, the amount of pressure transferred away from the wearer's metatarsal heads 112 may be less than if the cavity were empty. Thus, it may be desirable for the shoe sole to include an empty cavity so as to increase the amount of transferred pressure.

Figure 2:
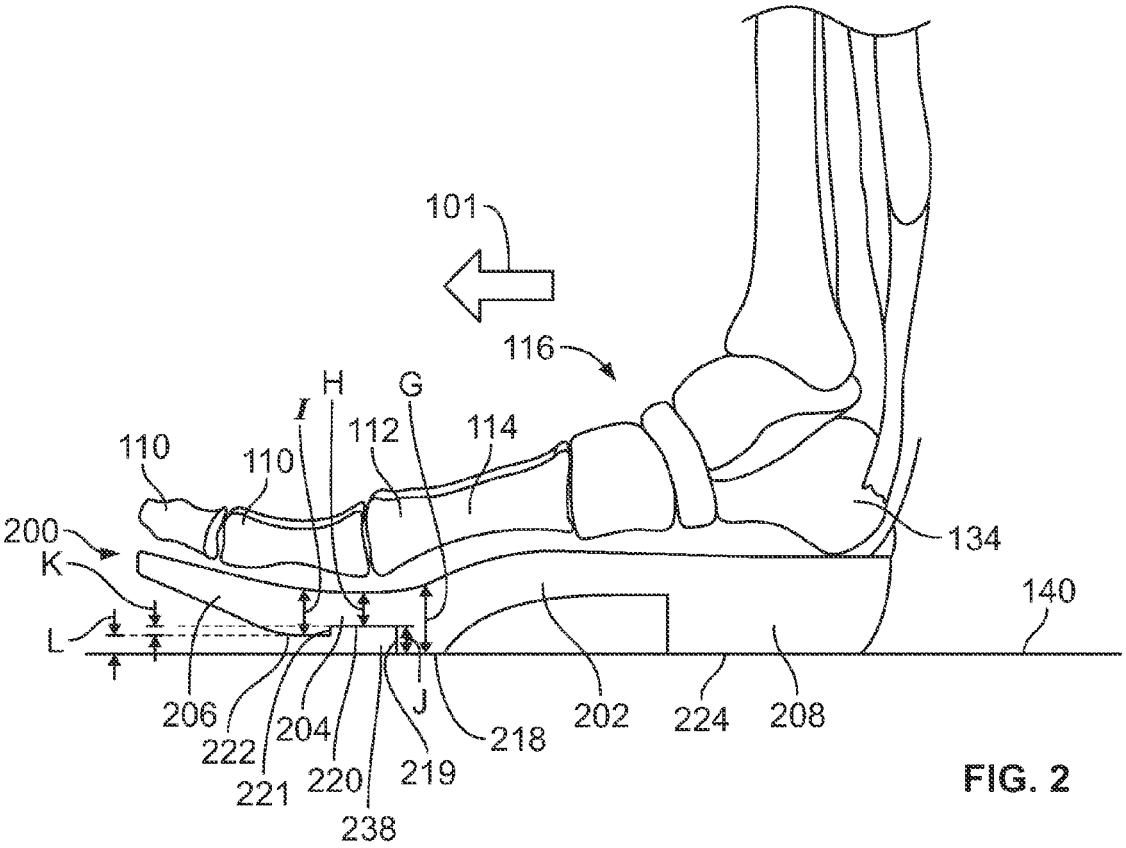
FIG. 2 shows a side view of a shoe sole with a toe region having a raised lower surface.
Figure 3:
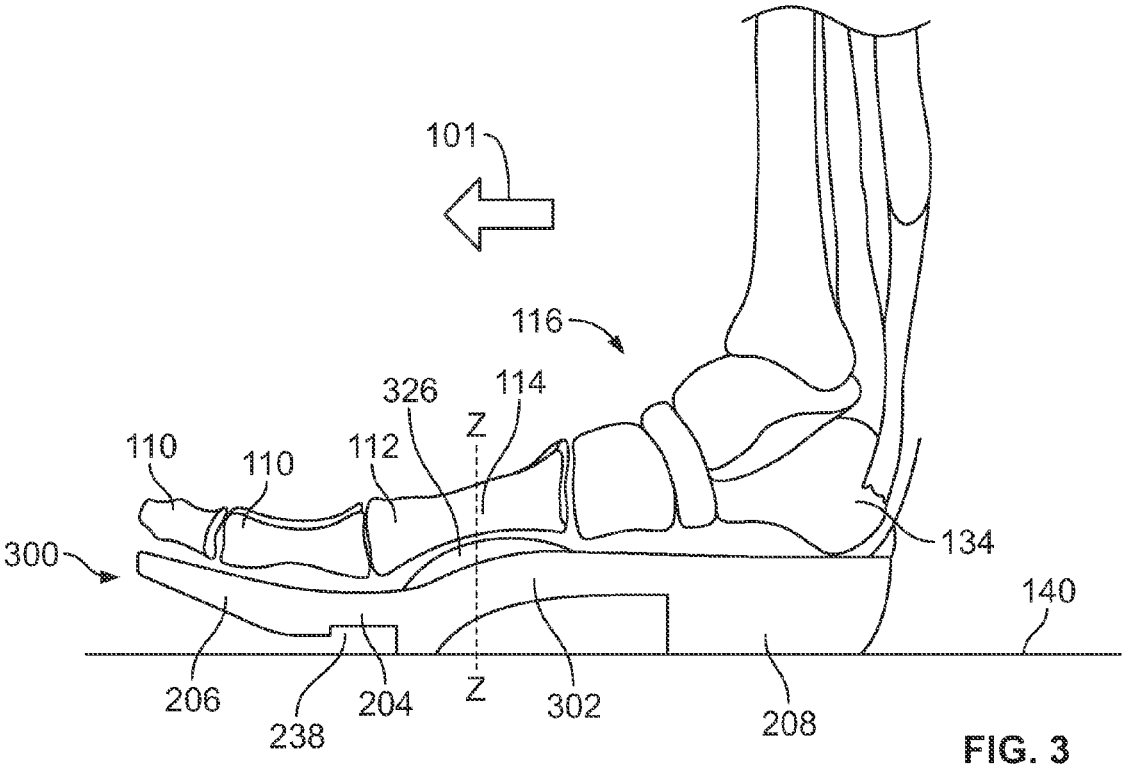
FIG. 3 shows a side view of a shoe sole with a shaft region having a raised upper surface.
Figure 5A:
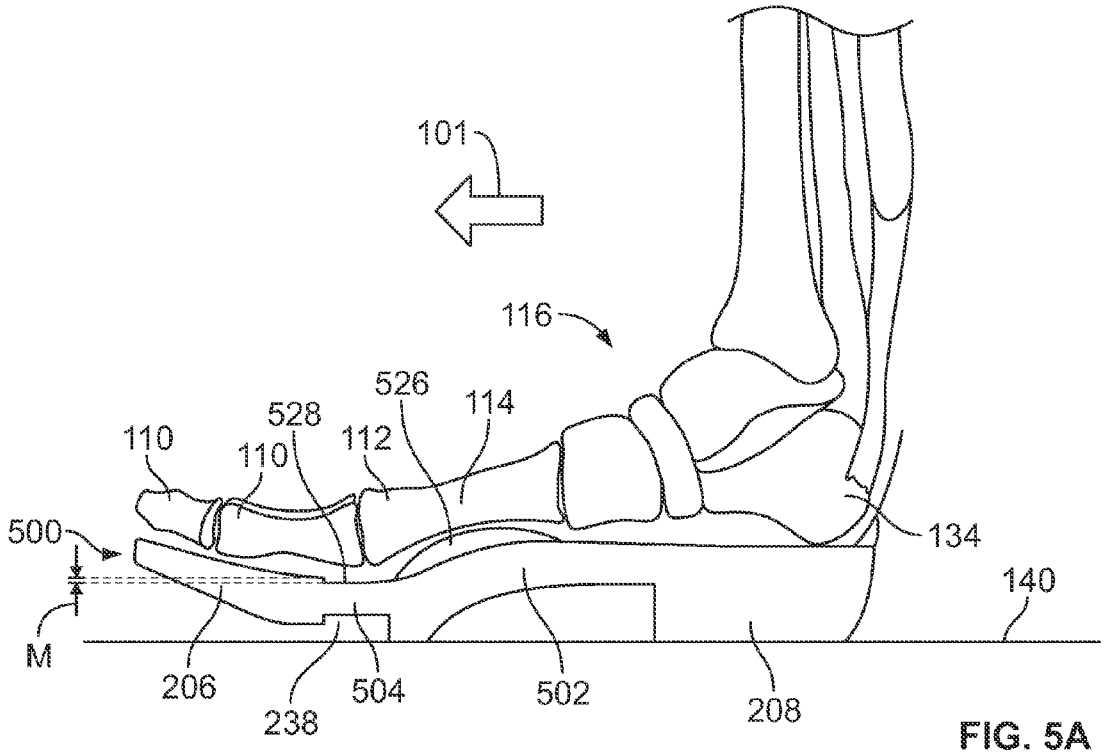
FIG. 5A shows a side view of a shoe sole with a shaft region having a raised upper surface and a ball region having a depressed upper surface.
Figure 5B:
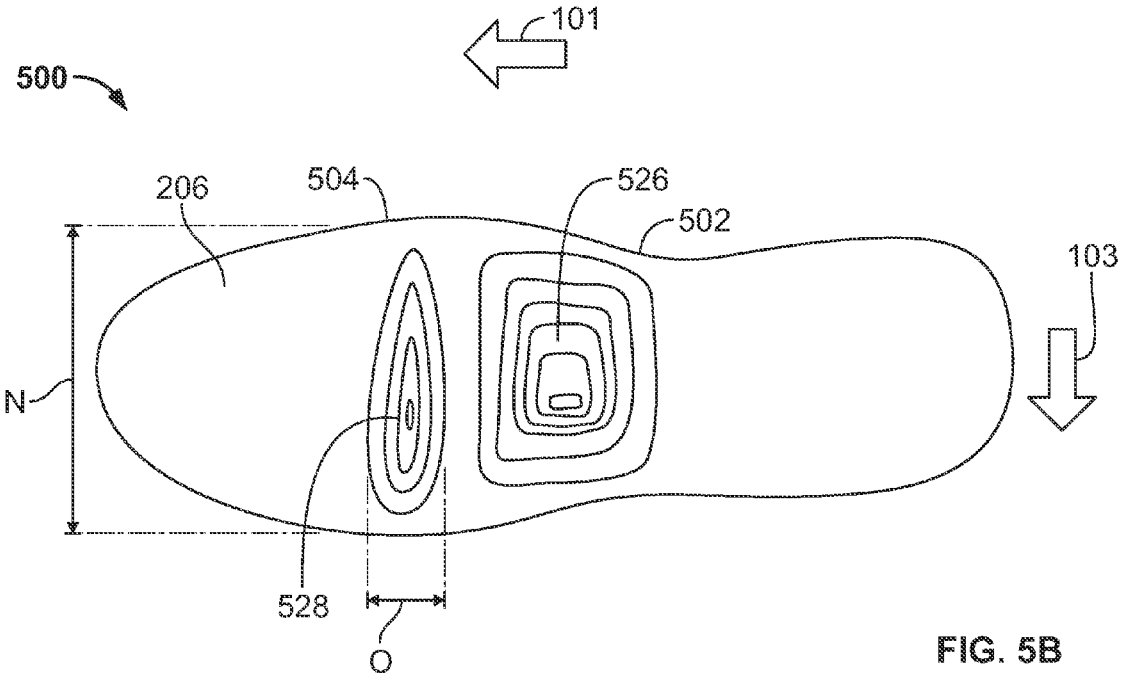
FIG. 5B shows a top view of the shoe sole of FIG. 5A.
Figure 6:
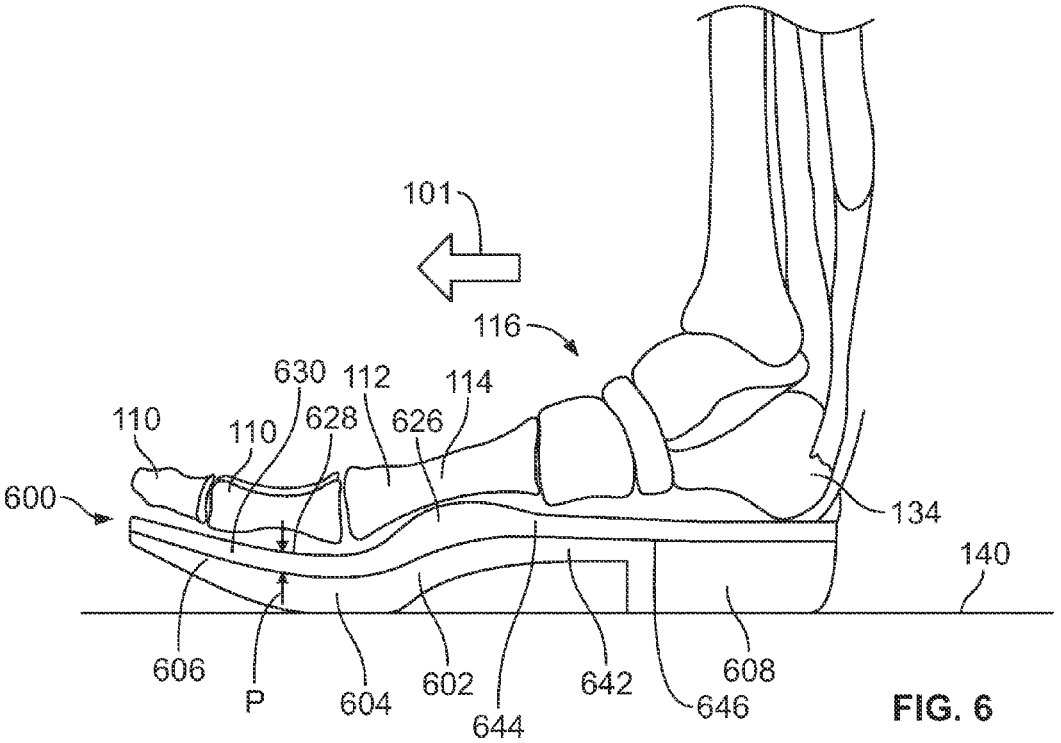
FIG. 6 shows a side view of a shoe sole with a shaft region having a raised upper surface.
Figure 7:
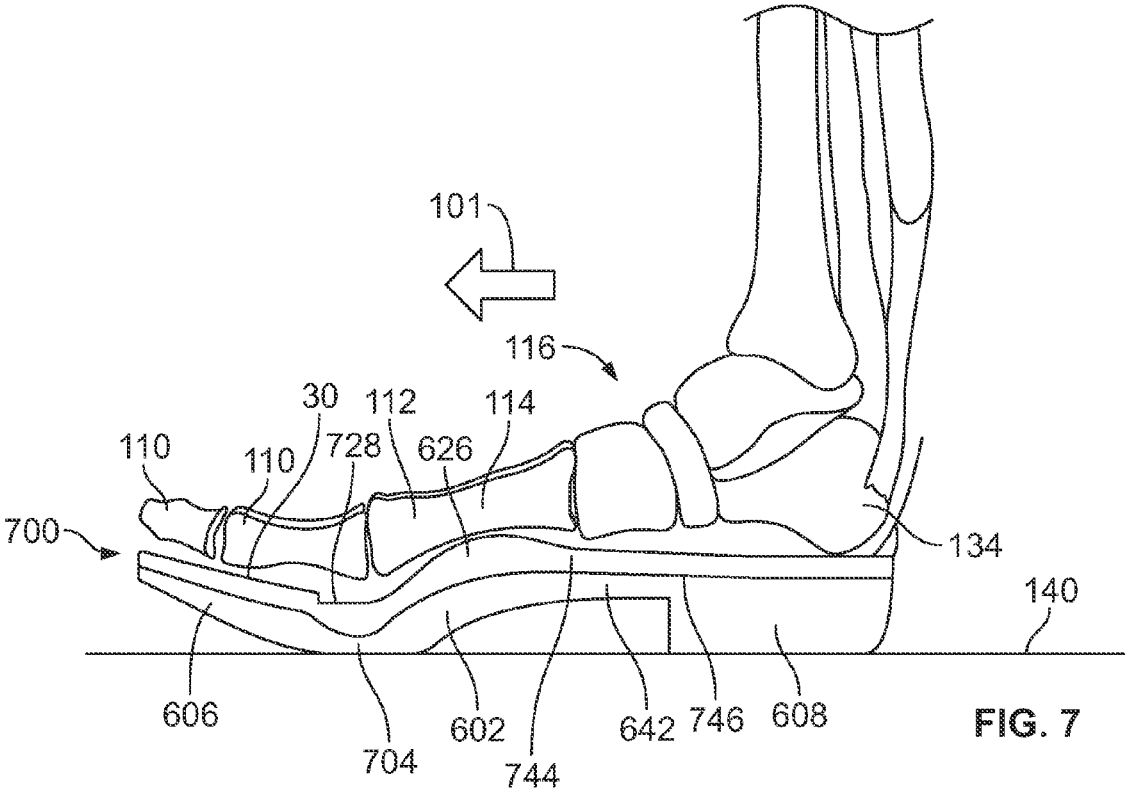
FIG. 7 shows a side view of a shoe sole with a shaft region having a raised upper surface and a ball region having a depressed upper surface.
Figure 8:
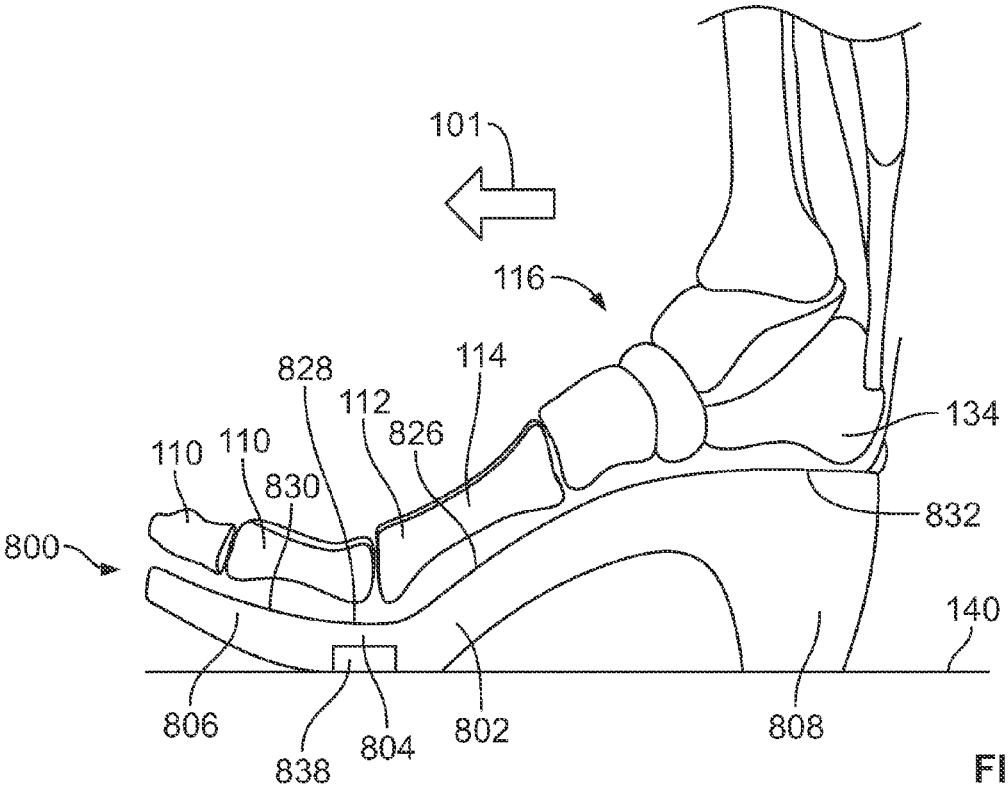
FIG. 8 shows a side view of a high-heeled shoe sole for relieving pressure from a wearer's metatarsal heads.
Figure 9:
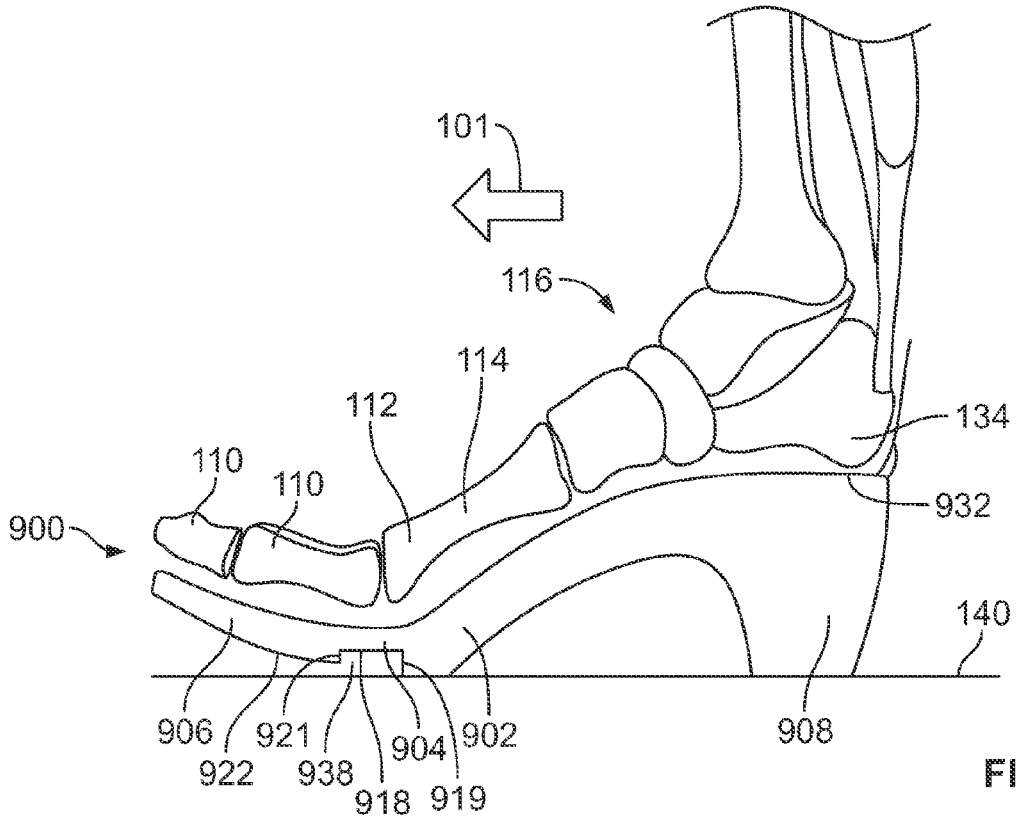
FIG. 9 shows a side view of a high-heeled shoe sole with a toe region having a raised lower surface.
Figure 10:
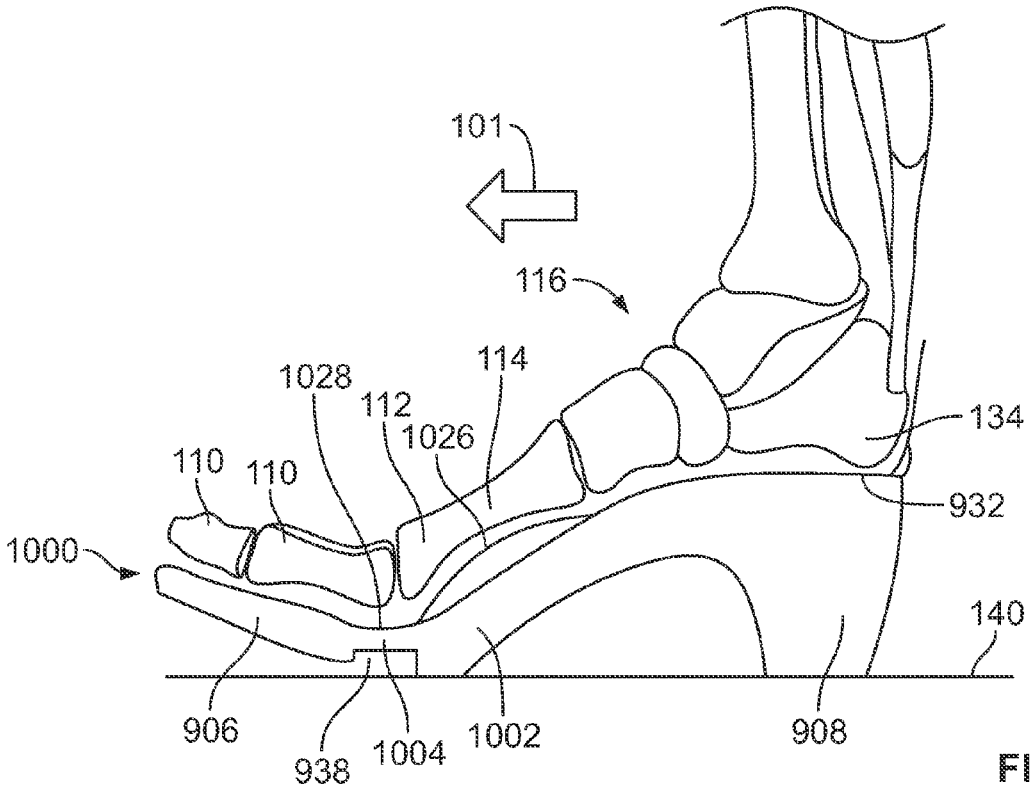
FIG. 10 shows a side view of a high-heeled shoe sole with a shaft region having a raised upper surface and a ball region having a depressed upper surface.

As shown in FIG. 1A, the upper surface 136 may be designed to interface with a natural foot shape of the wearer. For example, the upper surface 136 may be in part arcuate to interface with various parts of the natural anatomy of the foot 116, such as the heel 134, the arch of the metatarsal shafts 114, the metatarsal heads 112, and/or the phalanges 110. In some implementations, the shoe sole 100 is an outer sole configured to interface with a midsole and/or an insole positioned between the outer sole and the wearer's foot 116. In this case, the upper surface 136 is shaped to interface with a lower surface of the midsole and/or the insole. In general, any suitable upper surface or lower surface may be used in the shoe sole 100, and example shapes and configurations of the midsole and/or insole components are described in detail in relation to FIGS. 3-10. In particular, FIG. 2 shows an outsole configuration with a raised lower surface of a toe region, FIGS. 3 and 6 shows a midsole configuration with a raised upper surface of a shaft region, FIGS. 5A, 5B, and 7 show a midsole configuration with a raised upper surface of a shaft region and a depressed upper surface of a ball region, and FIGS. 8-10 show several different high-heeled shoe sole configurations with an elevated heel region. Each of the components described herein may provide some relief to a wearer's metatarsal heads and may be used alone in a shoe sole, or in combination with any other component. One of ordinary skill in the art will understand that a shoe sole including any combination of the various components (including raised portions and/or depressed portions of the lower surfaces and/or upper surfaces) may be used without departing from the scope of the disclosure.

As shown in FIG. 1A, the three lower surfaces 122, 118, and 124 all contact the ground 140. In general, the lower surfaces of the shoe sole 100 may not be co-linear. An example shoe sole where the lower surfaces are not co-linear is described in detail in relation to FIG. 2.

FIG. 2 shows a side view of a shoe sole 200 with a toe region 206 having a raised lower surface 222, according to an illustrative implementation. Similar to the shoe sole 100 of FIGS. 1A and 1B, the shoe sole 200 is an outsole including multiple connected regions underlying parts of a wearer's foot and is designed for relieving pressure from a wearer's metatarsal heads 112. The shoe sole 200 is substantially similar to the shoe sole 100 shown in FIGS. 1A and 1B and includes a shaft region 202 with thickness G, a ball region 204 with thickness H, and a toe region 206 with thickness I. As in the shoe sole 100, the ball region 204 has a lower surface 220 that is raised relative to a lower surface 222 of the toe region 206 and to a lower surface 218 of the shaft region 202, forming a cavity 238. The main difference between the shoe sole 100 shown in FIGS. 1A and 1B and the shoe sole 200 shown in FIG. 2 is in the height of the cavities of the shoe soles. In particular, in the shoe sole 100, the height D of the cavity 138 is substantially the same between the side surfaces 119 and 121. In contrast, the height of the cavity 238 in the shoe sole 200 varies between the side surfaces 219 and 221. In particular, the posterior side surface 219 has a larger height J than the height K of the anterior side surface 221. The larger height J compared to the height K causes the lower surface 222 of the toe region 206 to be raised relative to the lower surface 218 of the shaft region 202. As shown in FIG. 2, the height J is approximately twice as high as the height K. However, in general, the relationship between the heights J and K may be defined by $J=X\times K$, where X ranges between 1 and 2, or any other suitable range, such as between 1 and 3. As shown in the shoe sole 200 of FIG. 2, the height J is a fraction of the thickness of the shaft region 202 (i.e., G). In particular, the relationship between J and G may be defined by $J<G$. Similarly, the relationship between K and I may be defined by $K<I$. A similar relationship may be defined between the thickness of the ball region 204 (i.e., H), and any other dimension, such as $H<I$, $H<G$, or any other suitable relationship. Thus, when the lower surface 218 contacts the ground 140 (as shown in FIG. 2), the lower surface 222 is elevated at a height L (i.e., corresponding to the difference between the heights J and K, or J minus K) from the ground 140. In some implementations, the height L is less than 1 mm, and the weight of the user combined with a flexibility of the shoe sole 200 may cause the lower surface 222 to contact the ground 140 at a same time as the lower surfaces 218 and/or 224 contact the ground 140.

Thus, the change from the shoe sole 100 to the shoe sole 200 may be described as an increasing of the thickness of the shaft region 102 (i.e., G is greater than A) and/or a decreasing of the thickness of the toe region 106 (i.e., I is less than C). Either of these changes alone or the combination of these changes would result in the cavity 238 with varying height. By having a cavity 238 with a varied height, the shoe sole 200 may further relieve pressure from the metatarsal heads 112. In particular, when the wearer is standing, the lower surfaces 218 and 224 may contact the ground 140 (i.e., as shown in FIG. 2) while the lower surface 222 is elevated from the ground 140 (though the lower surface 222) may also contact the ground 140 as described above. As a result, the shaft region 202 exerts an upward force resisting the weight of the wearer that exceeds the upward force that is exerted by the ball region 204 or the toe region 202. Thus, pressure is relieved from the metatarsal heads 112 of the wearer by transferring the pressure away from the ball region 204 towards the shaft region 202.

In addition, the shoe sole 200 is configured to alter a gait cycle of the wearer so as to relieve pressure from the metatarsal heads 112 while the wearer is walking or running in the shoe. In particular, as the wearer walks forward, the foot 116 rolls forward such that a posterior portion strikes the ground 140 before anterior portions of the foot 116. For example, the heel may strike the ground 140 first, followed by the metatarsal heads 112 and the phalanges 110. By using a shoe sole 200 with a thick shaft region 202, as the foot 116 rolls forward, the lower surface 218 strikes the ground at an earlier time than it would if the shaft region 202 were thinner. As an example, because the thickness G of the shaft region 202 is larger than the thickness A of the shaft region 102, the lower surface 218 would strike the ground 140 earlier than the lower surface 118 would, thereby altering the gait cycle of the wearer.

In particular, by using a shoe sole 200 with a cavity 238, as the foot 116 rolls forward, the lower surface 218 strikes the ground at an earlier time than the lower surface of the shaft region of a shoe sole normally would without the cavity 238. The earlier strike of lower surface 218 lengthens the period of the gait cycle known as the midstance period, which may be defined as the time interval from a beginning time point (i.e., corresponding to when the contralateral (opposite) foot is removed from the ground) to an end time point (i.e., when the wearer's body weight is centered over the ipsilateral foot 116). During the midstance period, the wearer's body weight is loaded on the metatarsal shafts 114 for a longer amount of time due to the thicker shaft region 202, while the metatarsal heads 112 receive the loading for a shortened amount of time, compared to a shoe without a thicker shaft region such as the shaft region 202. The magnitude or area of the pressure-time integral (i.e., the impulse) on the metatarsal heads 112 is therefore less in the shoe sole 200 compared to a shoe without such a design. Thus, the earlier strike of the lower surface 218 relieves pressure on the metatarsal heads 112 during walking, jogging, or running by redirecting pressure away from this region.

As the wearer propels his weight forward, the next area of the shoe sole 200 that accepts the load is not the lower surface 220 but rather the lower surface 222. If the toe region 206 is thinner than the toe region 106 (i.e., if I is less than C), as the wearer's foot 116 rolls forward, the time that the lower surface 222 of the toe region 206 is in contact to the ground 140 is decreased relative to the corresponding time of the shoe sole 100. The wearer's normal gait cycle may thereby be altered by increasing an amount of time that the lower surface 218 is in contact with the ground 140 and by decreasing an amount of time that the lower surface 222 is in contact with the ground. The decreased amount of time that the lower surface 222 is in contact with the ground leads to a decreased time of propulsion (i.e., the length of the time interval between a start time when the ipsilateral heel is off the ground 140 and an end time when the ipsilateral toe is off the ground 140). Because of the decreased time of propulsion, the length of time that the wearer's weight is borne on the metatarsal heads 112 is decreased, thereby relieving pressure from the wearer's metatarsal heads 112 by redirecting the pressure away from the metatarsal heads 112 and towards the phalanges 110.

Therefore, by increasing the length of the midstance period, the shoe sole 200 alters the normal gait of the wearer and provides relief to the metatarsal heads 112 by transferring pressure away from this region towards the shaft region 202. Furthermore, by decreasing the length of the propulsion period, the shoe sole 200 provides further relief to the metatarsal heads 112 by redirecting pressure away from this region towards the toe region 206.

FIG. 3 shows a side view of a shoe sole 300 with a shaft region 302 having a raised upper surface 326, according to an illustrative implementation. Similar to the shoe sole 200 of FIG. 2, the shoe sole 300 includes multiple connected regions underlying parts of a wearer's foot and is designed for relieving pressure from a wearer's metatarsal heads 112. The shoe sole 300 includes an outsole that is substantially similar to the outsole of the shoe sole 200, but the shoe sole 300 further includes a raised upper surface 326 of the shaft region 302. The raised upper surface 326 may be a part of a midsole or an insole of the shoe sole 300. The raised upper surface 326 supports the wearer's metatarsal shafts 114 and relieves pressure from the metatarsal heads 112. In particular, by having a raised upper surface 326, the shaft region 302 provides further support for the metatarsal shafts 114 such that even more upward force is exerted on the metatarsal shafts 114 by the shaft region 302 than the shaft region 202 in the shoe sole 200. In some implementations, the raised upper surface 326 is uniform in height in a transverse (i.e., lateral to medial) direction. In other implementations, the raised upper surface 326 transversely varies in height. One example of a transversely varying raised upper surface is described in relation to FIG. 4.

Figure 4:
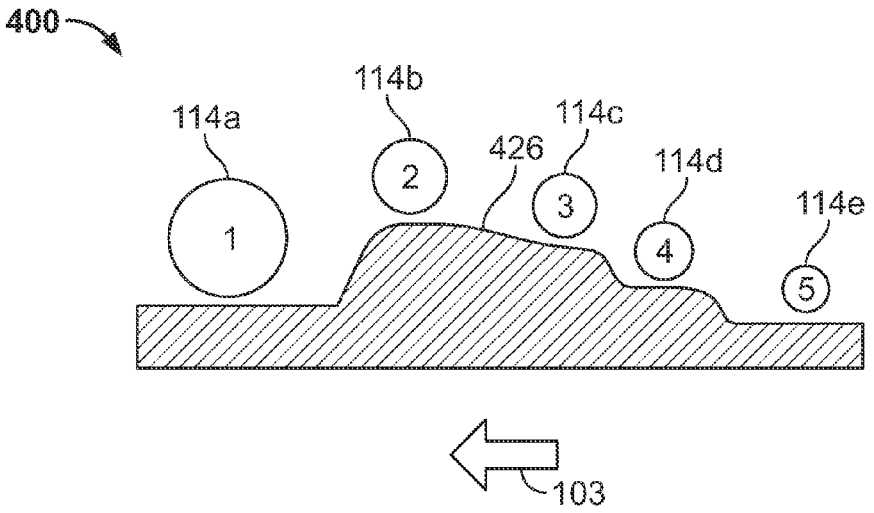
FIG. 4 shows a cross sectional view of a raised upper surface of a shaft region in a shoe sole.

FIG. 4 shows a cross sectional view 400 of a raised upper surface 426 of a shaft region 402 in a shoe sole taken at a plane Z in FIG. 3, according to an illustrative implementation. In particular, the raised upper surface 426 may be used as the raised upper surface 326 of the shoe sole 300, or the raised upper surface 426 may be used in any other suitable shoe sole. In the cross sectional view 400, the wearer's five metatarsal shafts 114*a*-114*e* (generally, metatarsal shaft 114) are shown, where the metatarsal shaft 114*a* corresponds to the first metatarsal shaft, the metatarsal shaft 114*b* corresponds to the second metatarsal shaft, the metatarsal shaft 114*c* corresponds to the third metatarsal shaft, the metatarsal shaft 114*d* corresponds to the fourth metatarsal shaft, and the metatarsal shaft 114*e* corresponds to the fifth metatarsal shaft. As shown in the view 400, the raised upper surface 426 has a transversely varying height that is highest underlying the metatarsal shaft 114*b*. The raised upper surface 426 is second highest under the metatarsal shaft 114*c*, followed by the metatarsal shaft 114*d*. Finally, as shown in FIG. 4, the raised upper surface has the lowest height for the metatarsal shafts 114*a* and 114*e*. By having the raised upper surface 426 shaped in this way, pressure is relieved from the metatarsal heads 112 of the wearer by providing increased upward force against the weight of the metatarsal shafts 114.

The raised upper surface 426 may be shaped in this way so as to provided targeted pressure relief. In particular, more weight may be borne by the second and third metatarsal heads (connected to the second and third metatarsal shafts, respectively) compared to the other metatarsal heads. By using an upper surface such as the raised upper surface 426 that increases the support under targeted metatarsal shafts, pressure from the corresponding metatarsal heads may be relieved. The shape of the raised upper surface 426 is shown for illustrative purposes only, and one of ordinary skill in the art that any such suitable upper surface may be used for supporting the metatarsal shafts of a wearer.

In particular, the varying height of the upper surface may be different from that shown in FIG. 4 and may be different for different wearers. For example, the upper surface may be customizable for the wearer based on the shape of the wearer's foot, or different types of upper surfaces may be recommended or provided to different types of wearers. In this case, the customization process may make the manufacturing process more complex, so it may be desirable to use the raised upper surface in an insole that is a removable insert to relieve the burden on the manufacturing. Furthermore, using a raised upper surface in a midsole or an insole that is not removable may be undesirable because different wearers with the same shoe size may nonetheless fit into the same shoe differently. Thus, the area of the foot that the raised upper surface contacts may not be the same in all wearers. This would possibly result in an inability to target the appropriate area(s) of the foot from which to relieve pressure, and further supports the placement of the raised upper surface 426 into a removable insert. On the other hand, it may be undesirable to use a removable insert because the insert may not remain in a fixed position within the shoe, and the movement of the insert within the shoe may also cause untargeted areas to be targeted.

FIGS. 5A and 5B show a side view and a top view, respectively, of a shoe sole 500 with a shaft region 502 having a raised upper surface 526 and a ball region 504 having a depressed upper surface 528, according to an illustrative implementation. Similar to the shoe sole 300 of FIG. 3, the shoe sole 500 includes multiple connected regions underlying parts of a wearer's foot and is designed for relieving pressure from a wearer's metatarsal heads 112. The shoe sole 500 includes an outsole that is substantially similar to the outsole of the shoe sole 300, but the shoe sole 500 further includes a depressed upper surface 528 of the ball region 504. The depressed upper surface 528 may be a part of an outsole, a midsole, an insole, or a removable insert of the shoe sole 500. The depressed upper surface 528 relieves pressure from the metatarsal heads 112 by lowering the upper surface 528 of the ball region 504. In particular, by having a depressed upper surface 528, more pressure may be applied to the metatarsal shafts 114 and the phalanges 110 when weight is applied to the wearer's foot 116.

As shown in FIG. 5B, the dimensions of the depressed upper surface 528 extend across a substantial portion of a width N of the shoe sole 500. The depressed upper surface 528 is substantially ovular and may be longer (along the direction 101) on a medial side and shorter on a lateral side of the shoe sole 500. The depressed upper surface 528 may be shaped in this way so as to underlie and conform to the natural shape of the wearer's metatarsal shafts. The depressed upper surface 528 may have a uniform depth in a transverse (i.e., lateral to medial) direction 103, or the depth of the depressed upper surface 528 may vary in the transverse direction. In some implementations, the depressed upper surface 528 extends across the entire width N of the shoe sole 500. In some implementations, the raised upper surface 526 is made of a stiffer material compared to the material used in the depressed upper surface 528. By using a more flexible material on the depressed upper surface 528 compared to a portion of a remainder of the shoe sole, the shoe sole 500 provides additional comfort for the wearer's metatarsal heads 112.

FIG. 6 shows a side view of a shoe sole 600 with a shaft region 602 having a raised upper surface 626, according to an illustrative implementation. Similar to the shoe sole 300 of FIG. 3, the shoe sole 600 includes multiple connected regions underlying parts of a wearer's foot and is designed for relieving pressure from a wearer's metatarsal heads 112. The shoe sole 600 is similar to the shoe sole 300 in that the shoe sole 600 includes a shaft region 602 with a raised upper surface 626, which is substantially similar to the raised upper surface 326 described in relation to FIG. 3. The raised upper surface 626 supports the wearer's metatarsal shafts 114 and relieves pressure from the metatarsal heads 112. In particular, by having a raised upper surface 626, the shaft region 602 provides further support for the metatarsal shafts 114 such that even more upward force is exerted on the metatarsal shafts 114 by the shaft region 602 than the shaft region 602 in the shoe sole 600. In some implementations, the raised upper surface 626 is uniform in height in a transverse (i.e., lateral to medial) direction. In other implementations, the raised upper surface 626 transversely varies in height. One example of a transversely varying raised upper surface is described in relation to FIG. 4. However, in contrast to the shoe sole 300, the shoe sole 600 does not include a cavity in the outsole.

The shoe sole 600 includes a midsole 644 and an outsole 642, which both include portions of the toe region 606, the ball region 604, the shaft region 602, and the heel region 608. In particular, the midsole 644 and the outsole 642 are shaped to such that a bottom surface of the midsole 644 contacts an upper surface of the outsole 642 at an interface 646. As shown in FIG. 6, the midsole 644 includes the raised upper surface 626 of the shaft region 602. The midsole 644 has a thickness P that thus varies along a length of the shoe sole 600. In certain implementations, the thickness P of the midsole 644 may be substantially uniform across the length of the shoe sole 600. In this case, the raised upper surface 626 may be a part of an insole (not shown) of the shoe sole 600. In general, the raised upper surface 626 may be a part of any part of a shoe sole, such as in the outsole, the midsole, the insole, or in a removable insert.

FIG. 7 shows a side view of a shoe sole 700 with a shaft region 602 having a raised upper surface 626 and a ball region 704 having a depressed upper surface 728, according to an illustrative implementation. The shoe sole 700 includes an outsole 642 which is the same as the outsole 642 shown in FIG. 6. The shoe sole 700 also includes a midsole 744, which is similar to the midsole 644 shown in FIG. 6 in that the midsole 744 includes a raised upper surface 626 on the shaft region 602, but the midsole 744 further includes a depressed upper surface 728 on the ball region 704. As was described in relation to FIG. 5A, a depressed upper surface supporting a wearer's metatarsal heads 112 relieves pressure from the metatarsal heads 112 by lowering the upper surface 728 of the ball region 704. In particular, by having a depressed upper surface 728, more pressure may be applied to the metatarsal shafts 114 and the phalanges 110 when weight is applied to the wearer's foot 116. In some implementations, the depressed upper surface 728 is uniform in height in a transverse (i.e., lateral to medial) direction. In other implementations, the depressed upper surface 728 transversely varies in height. One example of a transversely varying depressed upper surface is described in relation to FIG. 5B.

FIGS. 8-10 show side views of various high-heeled shoe soles for relieving pressure from a wearer's metatarsal heads 112. In particular, the high-heeled shoe soles shown in FIGS. 8-10 include an elevated heel region that elevates the heel 134 of the wearer. In an example, the heel 134 of the wearer may be elevated to a height of 1 inch, 1-4 inches, or any other suitable height of a heel. By elevating the heel 134, the pressure applied to the metatarsal heads 112 of the wearer's foot 116 tends to increase. Some data showing this general trend is shown in relation to FIGS. 13A and 14A. The high-heeled shoe soles shown in FIGS. 8-10 include several outsole, midsole, and insole characteristics that provide relief to the metatarsal heads 112 by transferring the pressure away from this region of the foot.

FIG. 8 shows a side view of a high-heeled shoe sole 800 for relieving pressure from a wearer's metatarsal heads 112, according to an illustrative implementation. The high-heeled shoe sole 800 is an outsole including multiple connected regions underlying parts of a wearer's foot. In particular, the high-heeled shoe sole 800 is similar to the shoe sole 100 in that the high-heeled shoe sole 800 includes a toe region 806, a ball region 804, a shaft region 802, and a heel region 808. The toe region 806 is substantially similar to the toe region 106 of the shoe sole 100, and the ball region 804 including a cavity 838 is also substantially similar to the ball region 104 of the shoe sole 100. However, the heel region 808 is much thicker than the heel region 108, thereby elevating the heel 134 of the wearer to a higher height compared to the elevation provided by the heel region 108. By elevating the heel 134 of the wearer, the shoe sole 800 effectively shifts weight from the heel 134 anteriorly in the direction 101 towards the phalanges 110 and/or the metatarsal shafts 112 of the wearer.

As described in relation to FIGS. 1A and 1B, a function of the cavity 838 is to relieve pressure from the metatarsal heads 112, compared to a shoe sole without such a cavity. Because the cavity 838 is positioned below the metatarsal heads 112, the shaft region 802 and the toe region 806 may each exert an upward force resisting the weight of the wearer that is greater than an amount of upward force exerted by the ball region 804. Thus, pressure is transferred away from the wearer's metatarsal heads 112 and towards the wearer's metatarsal shafts 114 and/or the wearer's phalanges 110. The transfer of pressure may have the same effect while the wearer is standing, walking, jogging, or running while wearing the shoe. The shape and/or dimensions of the cavity 838 may be similar to those of the cavity 138.

FIG. 9 shows a side view of a high-heeled shoe sole 900 with a toe region 906 having a raised lower surface 922, according to an illustrative implementation. The high-heeled shoe sole 900 is an outsole including multiple connected regions underlying parts of a wearer's foot. In particular, the high-heeled shoe sole 900 is similar to the shoe sole 800 described in relation to FIG. 8 in that the heel regions 808 and 908 of shoe soles 800 and 900, respectively, elevate the heel 134. Furthermore, the shaft region 902 and the ball region 904 are similar to the corresponding regions of the shoe sole 800. However, rather than resembling the toe region 806 of the shoe sole 800, the toe region 906 of the shoe sole 900 resembles the toe region 206 of the shoe sole 200 described in relation to FIG. 2.

In particular, similar to the shoe sole 200, the cavity 938 of the high-heeled shoe sole 900 has a varying height that is larger on a posterior side surface 919 compared to an anterior side surface 921. Thus, when the lower surface 918 contacts the ground 140, the lower surface 922 is elevated at a particular height from the ground 140. The change from the high-heeled shoe sole 800 to the high-heeled shoe sole 900 may therefore be described as an increasing of the thickness of the shaft region 802 to the shaft region 902 and/or a decreasing of the thickness of the toe region 806 to the toe region 906. Either of these changes alone or the combination of these changes would result in the varying height of the cavity 938. By having a cavity 938 with a varied height, the shoe sole 900 may further relieve pressure from the metatarsal heads 112. In particular, when the wearer is standing, the lower surfaces of the heel region 908 and the shaft region 902 may contact the ground 140 (i.e., as shown in FIG. 9) while the lower surface of the toe region 906 is elevated from the ground 140. As a result, the shaft region 902 exerts an upward force resisting the weight of the wearer that exceeds the upward force that is exerted by the ball region 904 or the toe region 902. Thus, pressure is relieved from the metatarsal heads 112 of the wearer by transferring the pressure away from the ball region 904 towards the shaft region 902. This is particularly useful in a high-heeled shoe, where pressure exerted on a wearer's metatarsal heads exceeds the exerted pressure in a shoe with a lower heel.

In addition, as was described in relation to FIG. 2, the gait cycle of the wearer may be altered so as to relieve pressure from the metatarsal heads 112 while the wearer is walking or running while wearing the shoe. In particular, as the wearer walks forward, the foot 116 rolls forward such that a posterior portion strikes the ground 140 before anterior portions of the foot 116. For example, the heel may strike the ground 140 first, followed by the metatarsal heads 112 and the phalanges 110. By using a shoe sole 900 with a thick shaft region 902, as the foot 116 rolls forward, the lower surface 918 strikes the ground at an earlier time than it would if the shaft region 902 were not as thick, thereby altering the gait cycle of the wearer and exerting an increased amount of pressure on the metatarsal shafts 114. Furthermore, if the toe region 906 is thinner than the toe region 806, as the wearer's foot 116 rolls forward, the time that the lower surface 922 of the toe region 906 strikes the ground 140 is delayed relative to the corresponding time of the shoe sole 800. Thus, because of the delay, the length of time that the wearer's weight is borne on the metatarsal shafts 114 is increased, thereby relieving pressure from the wearer's metatarsal heads 112 by redirecting the pressure away from the metatarsal heads 112 and towards the metatarsal shafts 114 and/or the phalanges 110.

FIG. 10 shows a side view of a high-heeled shoe sole 1000 with a shaft region 1002 having a raised upper surface 1026 and a ball region 1004 having a depressed upper surface 1028 and a cavity 938, according to an illustrative implementation. Similar to the high-heeled shoe sole 900 of FIG. 9, the shoe sole 1000 includes a cavity 938 and a thin toe region 906 with a lower surface that is elevated from the ground 140. The shoe sole 1000 additionally includes a raised upper surface 1026 on the shaft region 1002 and a depressed upper surface 1028 on the ball region 1004.

The raised upper surface 1026 of the shaft region 1002 may be the same as the raised upper surface 326 shown in FIG. 3, and may be a part of an outsole, a midsole, an insole, or a removable insert in a high-heeled shoe. The raised upper surface 1026 supports the wearer's metatarsal shafts 114 and relieves pressure from the metatarsal heads 112. In particular, by having a raised upper surface 1026, the shaft region 1002 provides support for the metatarsal shafts 114 such that an increased amount of upward force is exerted on the metatarsal shafts 114 by the shaft region 1002 compared to the shaft region 902 in the shoe sole 900. In some implementations, the raised upper surface 1026 is uniform in height in a transverse (i.e., lateral to medial) direction. In other implementations, the raised upper surface 1026 transversely varies in height. One such example of a transversely varying raised upper surface is described in relation to FIG. 4.

The depressed upper surface 1028 of the ball region 1004 may be the same as the depressed upper surface 528 as shown in FIGS. 5A and 5B. The depressed upper surface 1028 relieves pressure from the metatarsal heads 112 by lowering the upper surface 1028 of the ball region 1004. In particular, by having a depressed upper surface 1028, more pressure may be applied to the metatarsal shafts 114 and the phalanges 110 when weight is applied to the wearer's foot 116. In some implementations, the depressed upper surface 1028 is uniform in height in a transverse (i.e., lateral to medial) direction. In other implementations, the depressed upper surface 1028 transversely varies in height. One example of a transversely varying depressed upper surface is described in relation to FIG. 5B.

As described herein, any suitable upper surface or lower surface may be used in the shoe sole of the disclosure. The example shapes and configurations of the outsole, midsole, and/or insole components shown in FIGS. 1-10 are for illustrative purposes only, and one of ordinary skill in the art will understand that any combination of the various components described herein does not depart from the scope of the disclosure. For example, a depressed upper surface underlying the wearer's metatarsal heads 112 may be used in a shoe sole with or without having a raised upper surface underlying the wearer's metatarsal shafts 114, and with or without having a cavity underneath a ball region of the shoe sole. Furthermore, three example configurations for a high-heeled shoe sole are described in relation to FIGS. 8-10, but these are for illustrative purposes only, and one of ordinary skill in the art will understand that any of the components or combinations of components may be used in a shoe sole designed for a high-heeled shoe.

Figure 11B:
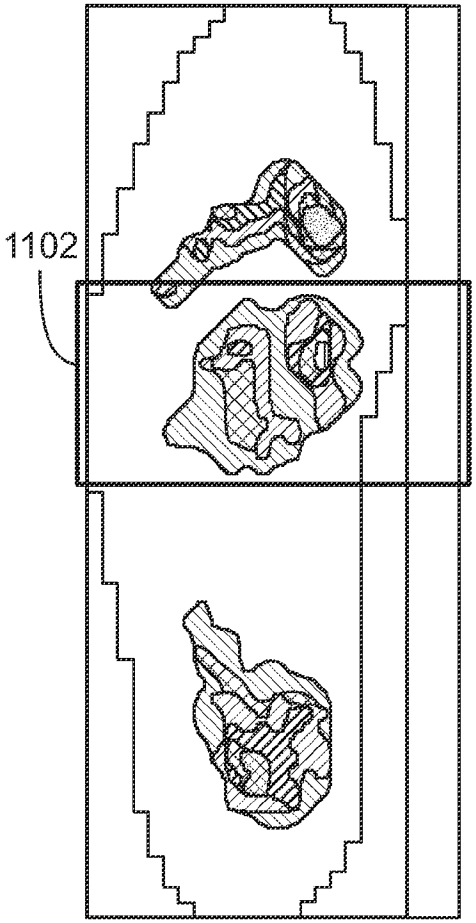
FIGS. 11A and 11B show graphical data showing amounts of pressure at different regions of a wearer's foot.
Figure 11A:
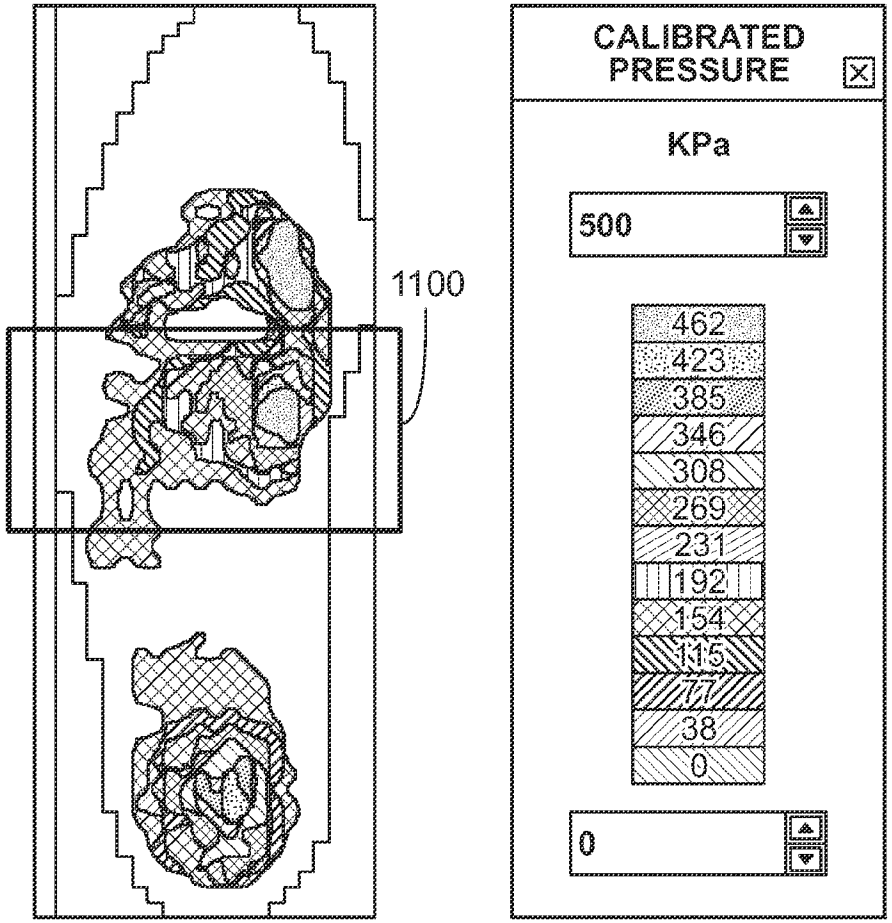

FIGS. 11A and 11B show graphical image plots indicating amounts of pressure at different regions of a wearer's foot. The image plot of FIG. 11A represents a baseline pressure distribution across a wearer's left foot while standing in a standard shoe, and the image plot of FIG. 11B represents the pressure distribution when the wearer is standing while wearing a shoe with an outsole cavity resembling the shoe sole 200 of FIG. 2. In FIG. 11A, the pressure distribution 1100 at the metatarsal heads (within the rectangle) shows that the pressure is as high as 460 kPa approximately under the first metatarsal head. The pressure generally decreases moving radially outward from the first metatarsal head, and the pressure is around 270 kPa near the second and third metatarsal heads. For comparison, the pressure distribution 1102 in FIG. 11B at the metatarsal heads shows that significantly less pressure is applied in this region when the wearer wears a shoe including the shoe sole 200. In particular, the peak pressure on the metatarsal heads has decreased significantly to around 240 kPa. The pressure distributions 1100 and 1102 demonstrate that the cavity and raised lower surface of the ball region of the shoe sole 200 in FIG. 2, relieves significant pressure from the metatarsal heads.

Figure 12:
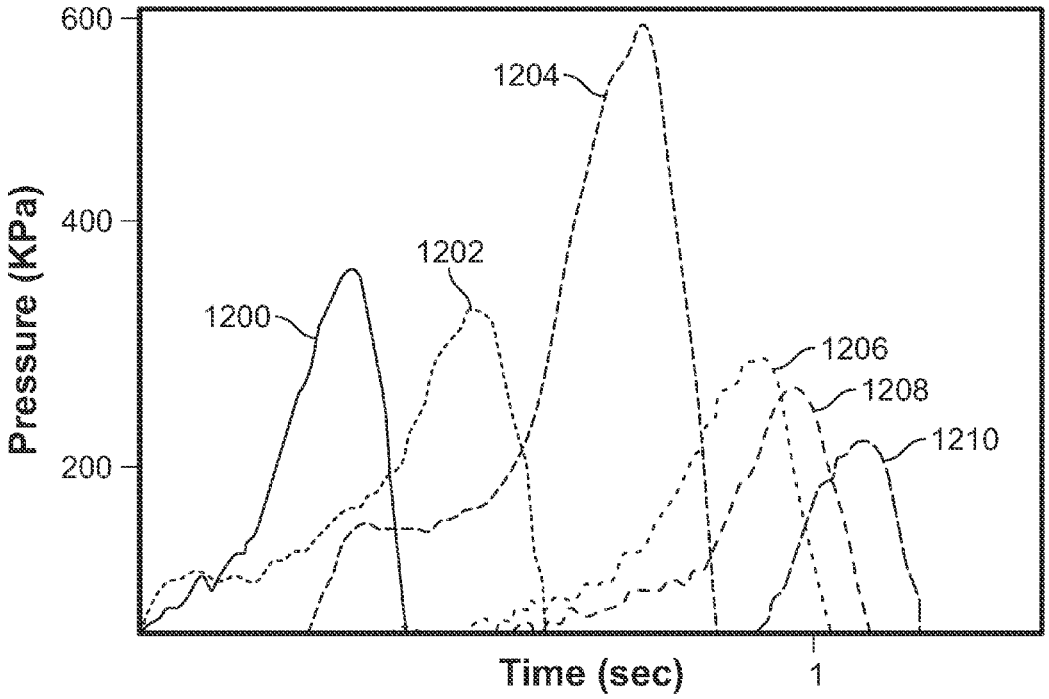
FIG. 12 shows graphical data showing varying amounts of pressure on a wearer's metatarsal heads during a walking cycle while wearing a high-heeled shoe.

FIG. 12 shows a graphical plot showing varying amounts of pressure on a wearer's metatarsal heads during a walking cycle while wearing a high-heeled shoe with a heel height of 30 mm and various modifications to the shoe sole. In FIG. 12, pressure in kPa is plotted against time in seconds. The pressure corresponds to an amount of pressure applied to the metatarsal heads of a wearer's foot during a walking cycle (i.e., one step). The different curves 1200-1210 correspond to amounts of pressure when the wearer wears a shoe with various configurations for the outsole, midsole, and/or insole as described herein.

During a walking cycle, the heel of the wearer's foot strikes the ground and the wearer's body weight is rolled from the back (posterior) of the foot towards the front (anterior) of the foot as the wearer's torso moves forward. As the weight shifts from the heel towards the front of the foot, the pressure on the metatarsal heads (i.e., the ball of the foot) gradually increases until full body weight is supported by the foot because the contralateral (i.e., opposite) foot is lifted off of the ground. The pressure on the metatarsal heads then decreases sharply as weight is transferred back to the other foot.

The curve 1204 shows a pressure exerted on the ball of the foot while wearing a standard high heeled shoe and represents a baseline pressure exerted on the ball of the foot while walking. The curve 1204 has a peak pressure at about 600 kPa. The curve 1200 shows the corresponding pressure for a shoe including a shoe sole with a cavity, similar to the high-heeled shoe sole of FIG. 8, and reaches a peak pressure of about 360 kPa during the walking cycle. A peak pressure of 360 kPa is significantly less than the baseline peak pressure of 600 kPa, indicating that including a cavity in the outsole of a high-heeled shoe has a significant pressure-relieving effect on the metatarsal heads of the foot. The curve 1202 shows the corresponding pressure for a high-heeled shoe including a shoe sole with a cavity, where a lower surface of the toe region is raised relative to a lower surface of the shaft region, similar to the high-heeled shoe sole of FIG. 9. The curve 1202 reaches a peak pressure of about 300 kPa, which is less than the peak pressure of the shoe sole of FIG. 8 (i.e., shown in the curve 1200). Thus, raising the lower surface of the toe region relative to the lower surface of the shaft region further helps to relieve pressure from the metatarsal heads of the wearer.

The curves 1206-1210 show the corresponding pressure for shoes including a raised upper surface on a shaft region and a depressed upper surface on a ball region. In particular, the curve 1206 shows the corresponding pressure for a shoe with a shoe sole similar to the shoe sole 700 of FIG. 7, but in a high-heeled shoe. The shoe corresponding to the curve 1206 may also correspond to the high-heeled shoe sole shown in FIG. 10, but without the cavity 938 in the outsole. In this case, the curve 1206 reaches a peak pressure of about 280 kPa. The curve 1208 shows the corresponding pressure for a high-heeled shoe sole with a cavity in the outsole, a raised upper surface of the shaft region, and a depressed upper surface of the ball region. In particular, the cavity in the outsole corresponds to the outsole shown in FIG. 8, or the same outsole as the shoe sole resulting in the curve 1200. In this case, the curve 1208 reaches a peak pressure of about 240 kPa. The last curve 1210 shows the corresponding pressure for a high-heeled shoe sole with a cavity in the outsole, a raised lower surface of a toe region 906 relative to a lower surface of a shaft region 1002, a raised upper surface 1026 on the shaft region 1002, and a depressed upper surface 1028 on the ball region 1004, similar to the high-heeled shoe sole 1000 of FIG. 10. The peak pressure of the curve 1210 is about 200 kPa, which is the lowest peak pressure among all the variations. As can be appreciated by FIG. 12, various modifications to the shoe sole cause a reduction in an amount of pressure exerted on the metatarsal heads of a wearer's foot. Furthermore, combining the modifications in various ways causes the amount of pressure applied to the wearer's metatarsal heads to be further reduced. Comparing an amount of reduction in pressure that is applied to a specific region of a wearer's foot for various combinations of modifications to the shoe sole, as shown in FIG. 12, may lead to shoe designs for relieving pressure from various parts of the wearer's foot.

Figure 13:
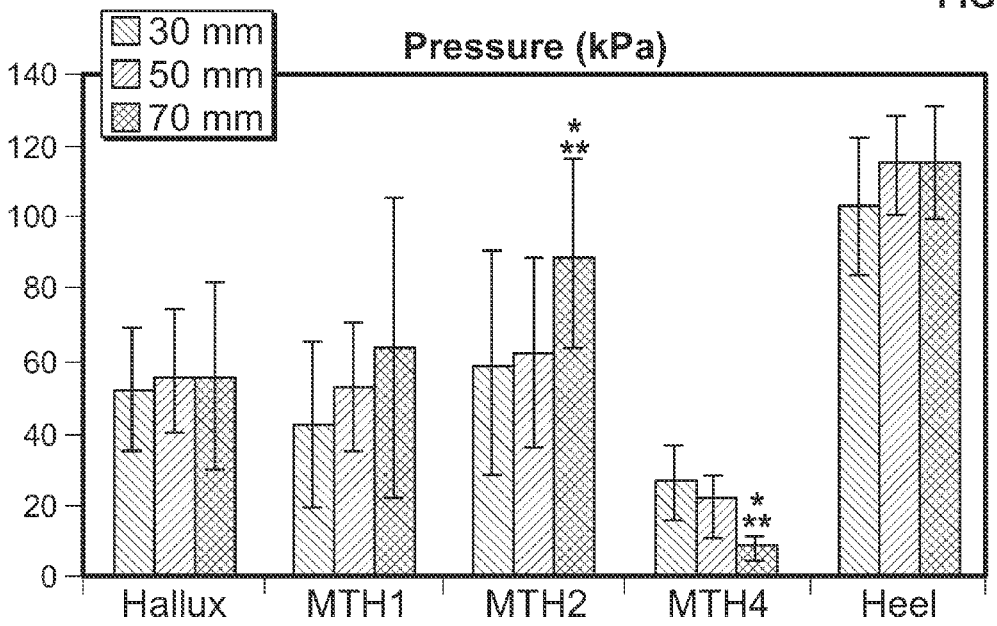
FIG. 13 shows data related to pressure on a wearer's foot during standing.

FIG. 13 shows data related to pressure on a wearer's foot during standing for various high heel heights. In particular, FIG. 13 shows the mean pressure in kPa for the hallux, three metatarsal heads, and the heel while standing in a regular shoe (i.e., without the cavity or raised or depressed upper surfaces as described herein). Heel heights of 30 mm, 50 mm, and 70 mm were tested on 10 subjects. As shown in FIG. 13, the pressure during standing remains generally stable on the hallux and heel as the heel height is increased, while the pressure increases in a stepwise manner for metatarsal heads 1 and 2 with increases in heel height. In contrast, metatarsal head 4 follows an opposite trend and decreases as heel height is increased. The opposite trend may be due to an attempt to stabilize a shift in the lateral to medial load across the rotational axes of the foot as the heel is elevated. The data shown in FIG. 13 may be used to design the dimensions of the various components of the shoe soles described herein for relieving pressure from the metatarsal heads.

Figure 14:
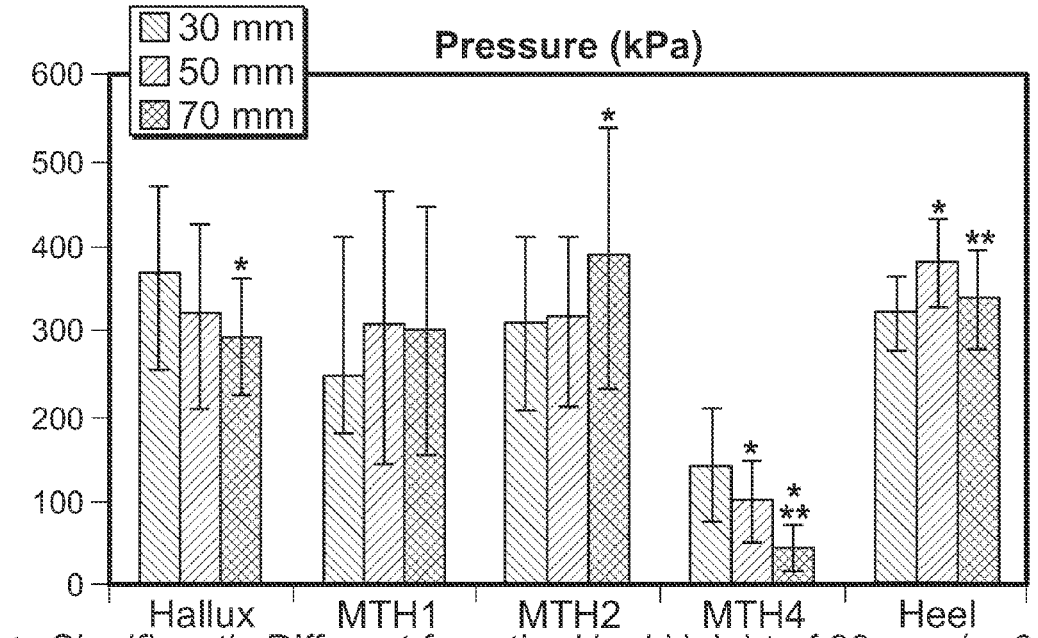
FIG. 14 shows data related to pressure on a wearer's foot during walking.

FIG. 14 shows data related to pressure on a wearer's foot during walking for various high heel heights. In particular, the graph in FIG. 14 shows the mean pressure in kPa for the hallux, three metatarsal heads, and the heel for 10 wearers while walking in a regular shoe (i.e., without the cavity or raised or depressed upper surfaces as described herein). Heel heights of 30 mm, 50 mm, and 70 mm were tested. A comparison between FIGS. 13 and 14 makes it apparent that walking in a regular shoe significantly increases the peak pressure (i.e., approximately a fourfold increase is shown) compared to standing. As the heel height increases, the pressure generally increases on metatarsal heads 1 and 2. In contrast, pressure for the hallux and metatarsal head 4 follow an opposite trend and decrease as heel height is increased. The opposite trend may be primarily due to the dynamics of walking in a high-heeled shoe. In particular, as the heel is elevated, a medial shift in load may be performed to balance a positional shift in rotational axes and a loss of propulsive function of the hallux.

Pressure may vary with the anatomy of different populations of people, so data such as the data shown in FIGS. 13 and 14 may be used to design a shoe sole for one or more groups of people. The data shown herein may also be used to determine an optimal heel height and pressure-relieving qualities in the design of a high heeled shoe with the various insole, midsole, and/or outsole modifications as described herein. For example, the amounts of pressure on the metatarsal heads may provide guidance for the design of the transversely varying shape of an upper surface of a shaft region.

Figure 15:
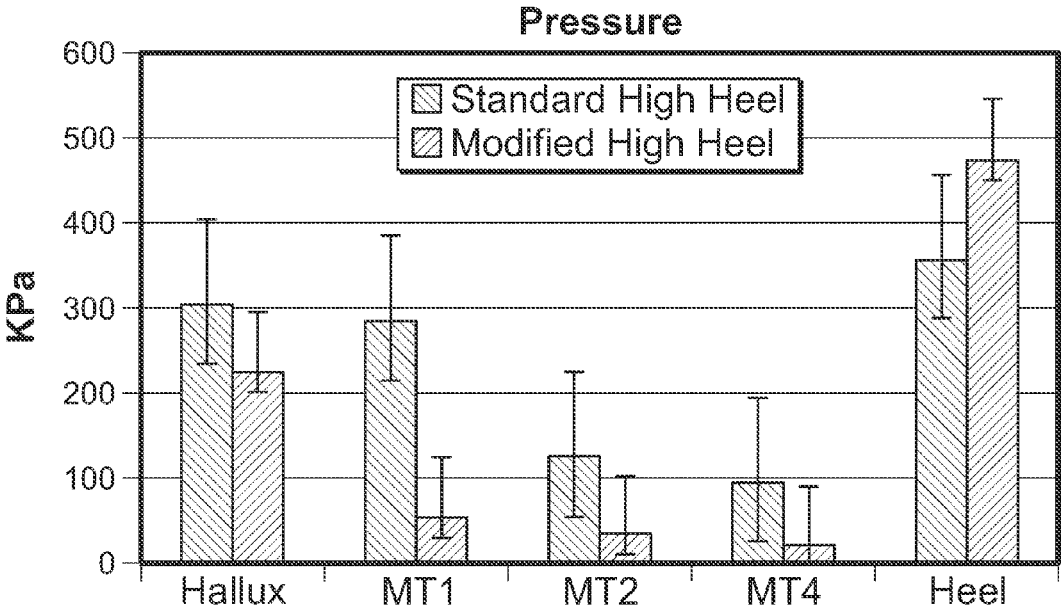
FIG. 15 shows data related to pressure on a wearer's foot for a standard high-heeled shoe and a modified high-heeled shoe.

FIG. 15 shows data related to pressure on a wearer's foot during walking for a standard high-heeled shoe and a modified high-heeled shoe. In particular, the graph in FIG. 15 shows the mean pressure in kPa for the hallux, three metatarsal heads, and the heel for 10 wearers while walking in a regular high-heeled shoe (i.e., without the cavity or raised or depressed upper surfaces as described herein) and a modified high-heeled shoe with a shoe sole similar to the high-heeled shoe sole 1000 shown in FIG. 10. The heel height of both the regular shoe and the modified shoe shown in FIG. 15 is 30 mm. The 10 wearers whose data are shown in FIG. 15 are different from the 10 wearers whose data are shown in FIG. 14. The difference between the regular high-heeled data in FIG. 15 and the data in FIG. 14 is due to the difference in populations between the two sets. In both the regular high-heeled shoe and the modified high-heeled shoe shown in FIG. 15, the heel height was 30 mm. As shown in FIG. 15, compared to the regular high-heeled shoe, the modified high-heeled shoe significantly decreased the peak pressures on the hallux and the metatarsal heads. While pressure was relieved from the metatarsal heads, other portions of the foot are likely to bear increased amounts of pressure. In particular, FIG. 15 shows that the pressure on the heel was larger for the modified high-heeled shoe compared to the regular high-heeled shoe. The combination of the decrease in peak pressure on the metatarsal heads and the increase in peak pressure on the heel suggests that the modified high-heeled shoe effectively transferred the pressure posteriorly away from the metatarsal heads and towards the heel.

Figure 16:
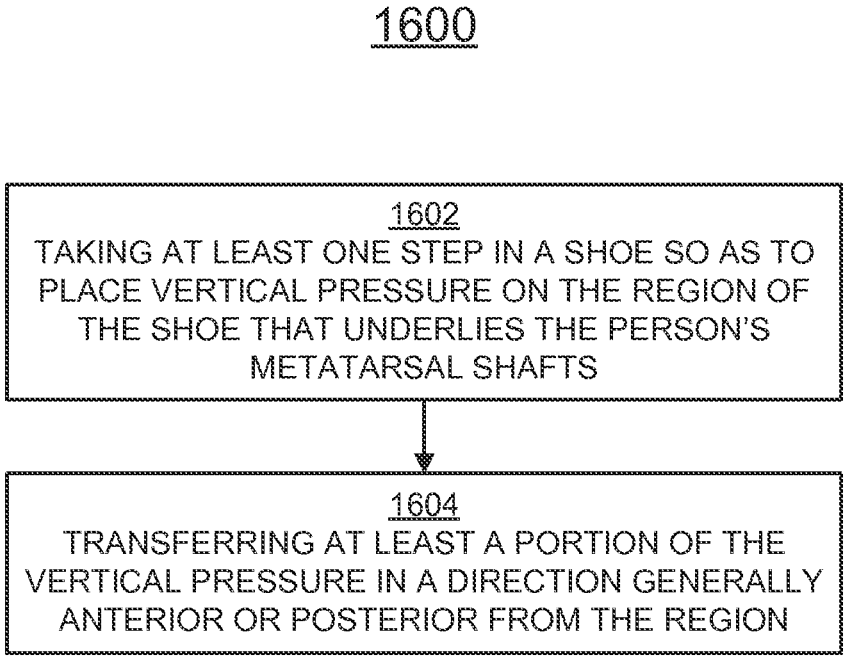
FIG. 16 shows a flow chart of a method for relieving pressure from a person's metatarsal heads.

FIG. 16 shows a flow chart of a method 1600 for relieving pressure from metatarsal heads of a person, according to an illustrative implementation. The method 1600 describes a process for transferring pressure across different regions of a shoe sole, and includes the steps of placing vertical pressure on a ball region of the shoe sole that underlies the person's metatarsal heads (step 1602), and transferring at least a portion of the vertical pressure in a direction generally anterior or posterior from the ball region (step 1604).

At step 1602, vertical pressure is placed on the ball region underlying the person's metatarsal heads. For example, the vertical pressure may be placed while the person is taking a step or standing while wearing a shoe including the shoe sole. In an example, the shoe sole 100 includes a ball region 104 that supports the person's metatarsal heads. When the person applies weight to the person's foot (e.g., by taking a step, standing, or any other suitable way to apply downward pressure to a foot), the shoe sole 100 exerts an upward vertical pressure, thereby supporting the applied weight.

At step 1604, at least a portion of the vertical pressure is transferred in a direction generally anterior or posterior from the ball region. In an example, a cavity 138 is formed under the ball region 104 and between the shaft region 102 and the toe region 106. A function of the cavity is to relieve pressure from the person's metatarsal heads 112 by causing the downward pressure exerted by the person's foot to be transferred away from the ball region 104. In the shoe sole 100, the shaft region 102 and the toe region 106 may each exert an upward force resisting the weight of the person that is greater than an amount of upward force exerted by the ball region 104. Compared to a shoe sole without a cavity 138, the shoe sole 100 with a cavity 138 causes the downward pressure exerted by the person's foot to be transferred away from the person's metatarsal heads 112 (i.e., where the upward force of the ball region 104 is less for the shoe sole 100 with the cavity 138 compared to a shoe sole without such a cavity). The pressure is transferred towards the person's metatarsal shafts 114 (i.e., where the upward force of the shaft region 102 is greater for the shoe sole 100 with the cavity 138 compared to a shoe sole without such a cavity) and/or the person's phalanges 110 (i.e., where the upward force of the toe region 106 is greater for the shoe sole 100 with the cavity 138 compared to a shoe sole without such a cavity). This transfer of pressure described herein may have the same effect while the person is standing, walking, jogging, running, or applying weight to the foot in any other way while wearing the shoe.

Variations and modifications will occur to those of skill in the art after reviewing this disclosure. The disclosed features may be implemented, in any combination and subcombination (including multiple dependent combinations and subcombinations), with one or more other features described herein. The various features described or illustrated above, including any components thereof, may be combined or integrated in other systems. Moreover, certain features may be omitted or not implemented.

Examples of changes, substitutions, and alterations are ascertainable by one skilled in the art and could be made without departing from the scope of the information disclosed herein. All references cited herein are incorporated by reference in their entirety and made part of this application.

What is claimed is:

1. A shoe outer sole for relieving pressure from a wearer's metatarsal heads, comprising:

a shaft region disposed in the outer sole adapted to underlie metatarsal shafts of the wearer, the shaft region comprising a first lower surface;

a ball region disposed in the outer sole adapted to underlie the metatarsal heads of the wearer, the ball region being anterior to the shaft region and comprising a second lower surface;

a toe region disposed in the outer sole adapted to underlie the phalanges of the wearer, the toe region being anterior to the ball region and comprising a third lower surface, wherein the second lower surface is raised relative to the first lower surface and the third lower surface; and a cavity positioned under the second lower surface and between the shaft region and toe region, wherein a length of the cavity varies in a transverse direction such that the length of the cavity is larger on a medial side of the outer sole and smaller on a lateral side of the outer sole.

2. The shoe sole of claim 1, wherein the cavity has a uniform height along a dimension of the shoe sole.

3. The shoe sole of claim 2, wherein the dimension is a width of the shoe sole and the cavity extends across substantially the entire width.

4. The shoe sole of claim 1, wherein the cavity relieves pressure from the metatarsal heads when the first lower surface is placed in contact with a ground surface and pressure is applied to the first lower surface.

5. The shoe sole of claim 4, wherein the relieved pressure is transferred from the ball region towards one or both of the shaft region and the toe region.

6. The shoe sole of claim 1, wherein the second lower surface is raised relative to the first lower surface by a first height J, and the second lower surface is raised relative to the third lower surface by a second height K different from J.

7. The shoe sole of claim 6, wherein J is greater than K.

8. The shoe sole of claim 7, wherein J being greater than K causes a modification to a gait cycle applied by the wearer while wearing a shoe having the shoe sole.

9. The shoe sole of claim 8, wherein the modification includes increasing a length of time that the first lower surface contacts a ground surface during the gait cycle.

10. The shoe sole of claim 9, wherein the modification relieves pressure from the metatarsal heads by transferring the relieved pressure from the ball region towards the shaft region.

11. The shoe sole of claim 7, wherein a relationship between J and K is defined by $J=X\times K$, where X is between 1 and 3.

12. The shoe sole of claim 6, wherein J and K are each between 1 and 3 mm.

13. The shoe sole of claim 1, having an upper surface comprising:

a first portion disposed above the shaft region;

a second portion disposed above the ball region; and a third portion disposed above the toe region, wherein the first portion is raised relative to the second portion and the third portion.

14. The shoe sole of claim 13, wherein the first portion has a transversely varying height that varies between medial and lateral points.

15. The shoe sole of claim 14, wherein the second portion comprises a depression.

16. The shoe sole of claim 13, wherein the first, second, and third portions are included in a midsole or an insole of the shoe sole.

17. The shoe sole of claim 1, further comprising a heel region disposed in the outer sole so as to underlie the wearer's heel, the heel region being posterior to the shaft region and comprising an upper surface that is elevated relative to the shaft region, ball region, and toe region.

* * * * *